US005514919A

United States Patent [19]

Walley

[11] Patent Number: 5,514,919

[45] Date of Patent: May 7, 1996

[54] ELECTRIC FENCE ENERGIZER HAVING A CONTINUOUSLY VARYING RANGE OF OUTPUT PULSE VOLTAGES

[75] Inventor: John L. Walley, Hamilton, New Zealand

[73] Assignee: Gallagher Electronics Limited, Hamilton, New Zealand

[21] Appl. No.: 977,534

[22] Filed: Nov. 17, 1992

[30] Foreign Application Priority Data

Nov. 18, 1991 [NZ] New Zealand ..... 240641

[51] Int. Cl.[6] ..... H05C 1/04

[52] U.S. Cl. ..... 307/109; 361/232; 256/10

[58] Field of Search ..... 307/108, 109, 307/130; 361/155, 156, 230, 232, 263, 256; 256/10

[56] References Cited

U.S. PATENT DOCUMENTS

| | | | |
|---|---|---|---|
| 2,333,224 | 11/1943 | Agnew | 256/10 X |
| 2,415,942 | 2/1947 | Farr et al. | 256/10 X |
| 3,325,717 | 6/1967 | Nellis | 256/10 X |
| 3,378,694 | 4/1968 | Griffeth | 256/10 X |
| 3,655,994 | 4/1972 | Malme | 256/10 X |
| 3,655,995 | 4/1972 | Malme | 256/10 X |
| 4,200,809 | 4/1980 | Madsen | 256/10 X |
| 4,394,583 | 7/1983 | Standing | 307/108 |
| 4,859,868 | 8/1989 | McKissack | 307/106 |

FOREIGN PATENT DOCUMENTS

| | | | |
|---|---|---|---|
| 0374055 | 6/1990 | European Pat. Off. | 256/10 |
| 4115630 | 11/1992 | Germany | 256/10 |
| 88/10059 | 12/1988 | WIPO | 256/10 |

*Primary Examiner*—Fritz Fleming
*Attorney, Agent, or Firm*—Poms, Smith, Lande & Rose

[57] ABSTRACT

An electric fence energizer including an energy storage capacitor (11), a controllable switch (17) for controlling the charge in the storage capacitor, a control circuit (15) connected to the controllable switch, and a sensor (19,20) that can relay information to the control circuit regarding the perceived electrical load on the output of the electric fence energizer. The control circuit upon receipt of the information from the sensor operates the controllable switch so that the charge on the capacitor varies so as to allow a continuously varying range of output voltages on the electric fence line once the capacitor is discharged.

18 Claims, 1 Drawing Sheet

FIG. 1
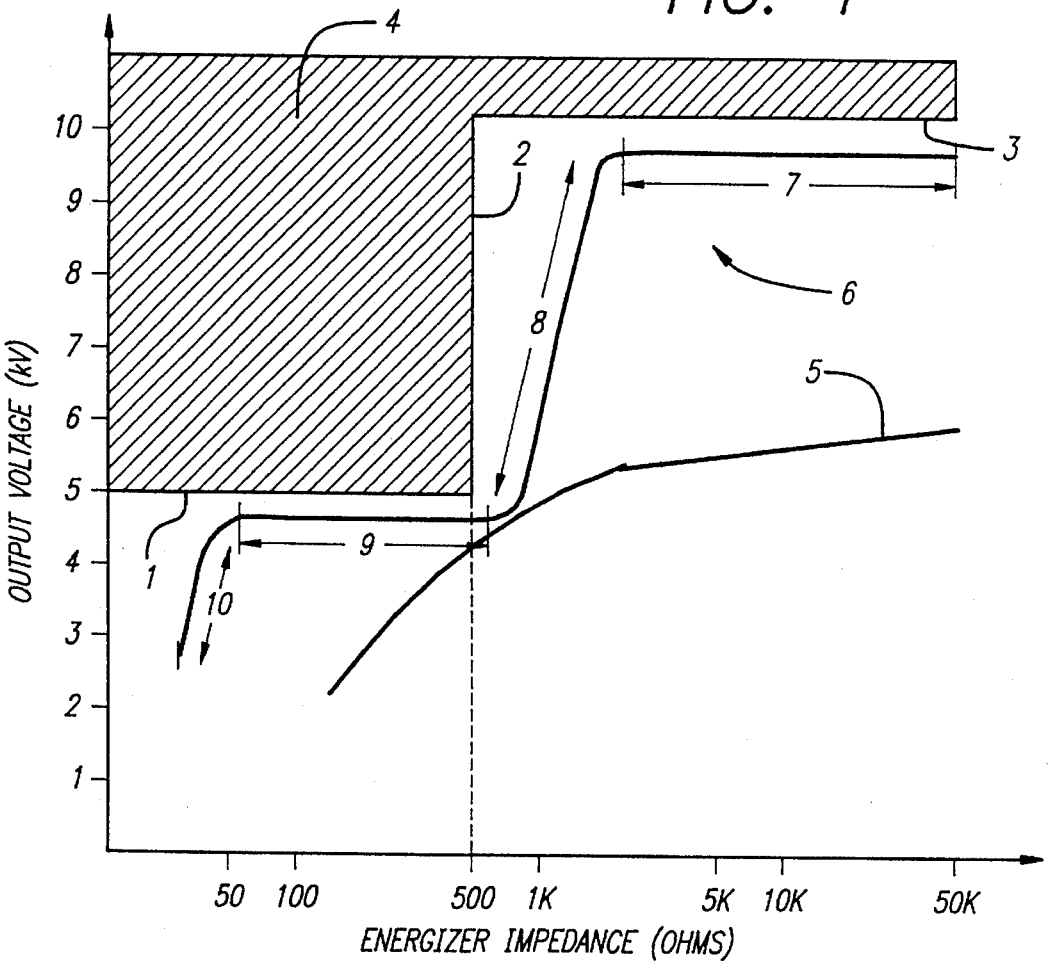
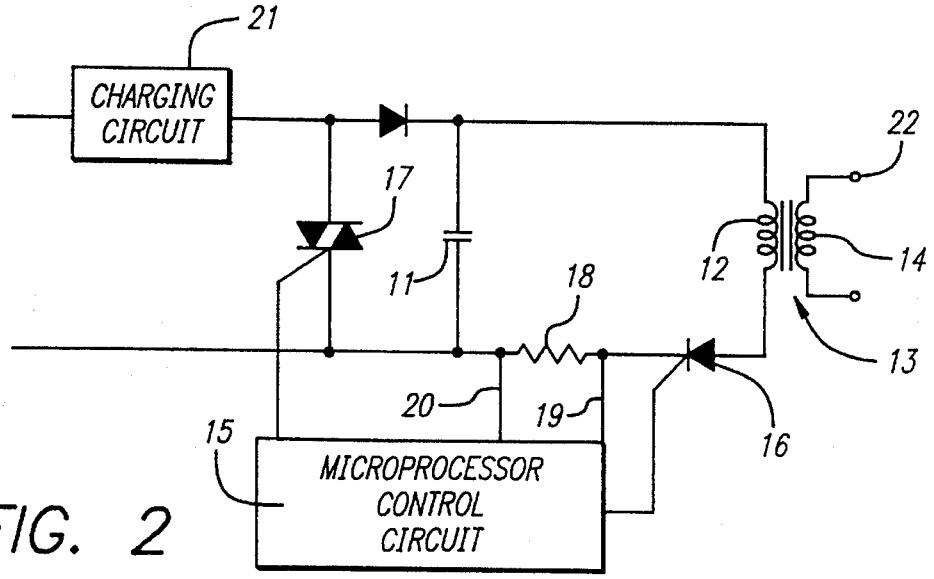
FIG. 2

ELECTRIC FENCE ENERGIZER HAVING A CONTINUOUSLY VARYING RANGE OF OUTPUT PULSE VOLTAGES

TECHNICAL FIELD OF THE INVENTION

This invention relates to improvements and modifications to electric fence energisers.

BACKGROUND OF THE INVENTION

The electric fence industry is highly regulated with restrictions being placed on various electrical parameters associated with electric fences. For instance, there are restrictions on the maximum amount of energy output from an electric fence energiser, the maximum current allowed as well as maximum voltages set according to the load under which the energiser is placed.

Unfortunately, these standards do not mimic the operating characteristics of standard electric fence energisers and therefore electric fence energisers have not been able to achieve an optimum performance within those standards.

For example, one set of operating standards specifies a simple step function for output voltage according to energiser load. A standard electric fence energiser has its output voltage varying with load as well, but with a function which is represented by a shallow curve. In order for a standard energiser to meet the lower voltage requirements for the lower energiser load (in ohms) the maximum output voltage from the energiser at the higher loads is significantly less than that allowed under the standards.

This is of concern, as the present inventors have found that an electric pulse propagates along an electric fence line more readily if there is provided a higher output voltage. Further, a high voltage pulse is preferable for physiological reasons as a high voltage pulse can deliver a shock of greater magnitude through the body of an animal more effectively than a low voltage pulse.

Another problem with electric fence energisers is that occasionally conductive material may fall on the fence and create a continual current drain on the energiser causing it to become undesirably hot.

A further problem is that over a period of time, long grass may grow against the electric fence providing a conductive path. This allows increased current to flow and causes the output voltage on the fence to drop. This is obviously undesirable as the effectiveness of the fence pulses has now been reduced.

It is an object of the present invention to address the above problems, or at least to provide the public with a useful choice.

SUMMARY OF THE INVENTION

According to an alternative aspect of the present invention there is provided an electric fence energiser including an energy storage capacitor, a controllable switch arranged to control the charge on the storage capacitor, a control circuit connected to the controllable switch, a sensing means that can relay information to the control circuit regarding the perceived electrical load on the output of the electric fence energiser, characterized in that the control circuit upon receipt of the information from the sensing means operates the controllable switch so that the charge on the storage capacitor does not exceed a pre-set value for a particular load on the electric fence energiser.

According to one aspect of the present invention there is provided a method of operating an electric fence energiser characterized by the steps of:

a) monitoring the effective load on the electric fence energiser; and b) adjusting the voltage on the energy storage capacitor of the energiser in accordance with the indicated load so the output voltage from the electric fence energiser is a preset value.

BRIEF DESCRIPTION OF THE DRAWINGS

Aspects of the present invention will now be discussed by way of example only with reference to the accompanying drawing in which:

FIG. 1 is a graphical representation comparing energiser output voltages with typical standards set for electric fence energisers, and FIG. 2 is a schematic diagram of one possible circuit to be used in accordance with the present invention.

DETAILED DESCRIPTION OF PREFERRED EMBODIMENTS

It should be noted that throughout this specification the voltage and charge on the energy storage capacitor will be used interchangeably as appropriate.

There is an electric fence energiser known that prevents the storage capacitor from being charged to more than a maximum amount. However, this differs from the present invention as there is only one possible level of charge that can be stored on the capacitor and this level is irrespective of the electrical load on the output of the energiser. Therefore, this energiser does not give optimum performance when complying with the international standards (such as IEC standards), particularly if the international standards indicate a step function with respect to output voltage and energiser load.

Another electric fence energiser is known that does monitor the load on the output of the energiser. Where this differs from the present invention is that instead of altering the charge on the storage capacitor in accordance with the load, the energiser switches in a second output stage when the load on the output reaches a certain level. The discrete nature of having two output stages in this energiser is not very satisfactory as the output voltage of the energiser is, under certain loads, well below the maximum allowable voltage specified by the standards. Further the duplication of output stages in the energiser each having a separate transformer is expensive.

Unlike the prior art, the present invention does not rely on a large amount of extra componentry, nor is it limited by only having the ability to charge the storage capacitor only to a single maximum level.

The present invention unlike all previous energisers varies the charge on the storage capacitor in accordance with the indicated load on the energiser. The advantages of this are immediately apparent.

The output fence voltage can be kept as high as possible with respect to the standards set. This ensures optimum pulse propagation along the fence line and provides better shocking characteristics. Another advantage is that with the output voltage being directly responsive to load, it is immaterial whether grass has grown against the fence as the output voltage is adjusted to take into account this loading.

Another advantage is that the current flow for the load is optimised and therefore a cooler unit is achieved as less energy is dissipated. If a conductive object shorts the fence and doesn't move away, the present invention can be used to drop the output voltage and hence the energy being dissipated by the electric fence energiser.

Yet another advantage of the present invention is that a transformer with a higher turns ratio can be used. Previously, an average turns ratio was 1:14. A higher ratio could not be used with previous energisers as under certain loads, the energiser would exceed the lower of the maximum output voltage standards. As the charge and hence voltage on the capacitor can be varied by the present invention, a higher turns ratio, say greater than 1:18 and more likely in the order of 1:25 may be used. This has the advantage that less charge is required on the energy storage capacitor.

The sensing means which provides an indication of the load may be achieved by a number of ways. In one embodiment, current feedback may be used. A resistor of known value can be placed on the secondary side of the energiser output transformer. The voltage across the resistor can be measured, from which the current can be calculated and used to estimate the energiser load.

In an alternative method, a resistor of a known value may be placed on the primary side of the energiser circuit and the voltage measured across the resistor. From this the current can be calculated and hence the effective impedance on the secondary side of the energiser. There are, however, some disadvantages with using current feedback as the current tends to change when capacitive loads are placed on a circuit.

In a preferred embodiment, voltage feedback will be used. For instance, the energiser load may be estimated from the peak voltage at the secondary side of the transformer. This can be achieved by a number of ways. The peak voltage on the secondary side can be measured while maintaining the isolation between the transformer primary and secondary through a capacitor divider network or a tertiary winding on the output transformer.

In an alternative method, a constant capacitor voltage test pulse can test the fence line load and from the measured output voltage, the effective load calculated.

As an alternative a system of measuring the phase angle between the voltage and current wave forms may be used.

The charge and hence the voltage on the storage capacitor may be controlled by a number of means. In a preferred embodiment, a controllable switch is interposed between the charging circuit for the energiser and the capacitor and can be switched on and off to control the charge reaching the capacitor as desired. In one embodiment, this controllable switch may be a triac, but it should be appreciated that other switching devices, perhaps thyristors, other SCRs, mechanical devices, optical switches and so forth may be used.

It is envisaged that in a preferred embodiment, microprocessor/controller technology will be used in the control circuit. The controllable switch may be connected to one of the ports on the microprocessor. When the microprocessor receives feedback from the sensing mechanism which gives an indication of the load on the fence, the microprocessor may then calculate a value (in accordance with a function) or access a value from a table within memory means (for instance in an EPROM). This value is indicative of the voltage which should be on the energy storage capacitor that gives the desired output voltage on the fence line once the capacitor is discharged through the energiser transformer. The microprocessor then may open or close the controllable switch as appropriate to allow the energy storage capacitor to be charged to that value.

Obtaining the appropriate level of charge on the capacitor may be achieved by a number of ways. One of the simplest means to ensure that it is charged to the appropriate level is to monitor the time that the controllable switch is opened or closed. This is possible as generally the capacitor is fully discharged for each pulse of the energiser and the charging rate of the capacitor follows a known characteristic curve. Alternatively, the voltage across the storage capacitor may be measured and the controllable switch operated as appropriate.

Having particular reference to the drawings, FIG. I is a semi-log graph of output voltage in kV versus the energiser impedance in ohms. It should be appreciated that a high energiser impedance represents an open circuit, that is when no animal or other conductive body is leaning against the electric fence. A low energiser impedance represents a short circuit, that is when there is an animal or some other conductive body leaning against the fence. The lines 1, 2 and 3 delineating the shaded area 4 represent one set of international standards (IEC) set for output voltage with respect to the energiser impedance. This particular standard follows the step function 4 as shown. The present invention can, of course, be applied to other standards.

The curve 5 represents a function of output voltage versus energiser impedance for a typical electric fence energiser. It can be seen that under high impedance, the output voltage of a typical electric fence energiser is considerably below that allowable by the standards indicated by line 3. The reason for this is apparent when one views the curve 5 when the energiser impedance is 500 ohms, that is where lines 1 and 2 intersect. At this loading, the output voltage of a typical energiser is very close to the standards set for output voltage at impedances under 500 ohms. The output voltage of a typical energiser at high impedances could be increased to be closer to the specified standards. However, because of the shape of the curve 5, the output voltage of the energiser would exceed the specified standards under low impedances.

A possible output function for an electric fence energiser operating in accordance with the present invention is indicated by numeral 6. The function 6 essentially is comprised of four sections 7, 8, 9 and 10.

Section 7 illustrates the high output voltage which can be achieved under heavy impedances which is close to that specified in the standards. If a transformer is used with a higher turns ratio than average, then this high voltage can be achieved without increasing the usual charge on the energy storage capacitor.

The high voltage indicated by section 7 gives good pulse propagation properties as well as desirable shocking characteristics. It can also be readily seen by purchasers of an electric fence energiser in accordance with the present invention that under high impedances the output voltage is considerably more than that given by standard electric fence energisers.

It should be appreciated that to achieve the straight line of section 7, the energy storage capacitor is required to be charged more for the lower impedances than for the higher impedances and this is achieved by the adaptive control of the present invention. Adaptive control allows an energiser's output characteristic to be adjusted to optimise the operation of the energiser to a set of particular operating conditions. This adaptive control also accounts for the possibility of long grass growing against the fence.

Section 8 of the function 6 illustrates the transition required for the electric fence energiser to adapt its output voltage from being close to that specified by the standards for high impedance to be under the output voltage specified for low impedances. Depending on the values of the componentry within the energiser, section 8 may either be achieved by the use of adaptive control as in the present invention, or may result from the natural effect of decreasing impedance on output voltage as illustrated by curve 5.

Section 9 of the electric fence energiser is achieved in a similar manner to section 7 discussed above. Again it can be seen that the output voltage achieved is very close to that specified by the standards and considerably higher than that achieved by typical electric fence energisers.

Section 10 represents a drop in voltage which occurs under very low impedances such as what may happen if a conductive body is left to short the electric fence. It is thought that by having the voltage drop under this situation, the energy dissipated by the energiser will be less and hence there will be less power drain and the energiser will run cooler. It should be noted that the purpose of providing shocks is to encourage bodies to move away from the fence and therefore if a body has been on the fence for a period of time, it is unlikely to move away and hence a drop in voltage is desirable in this situation. In this way, the electric fence energiser achieves a continuously varying range of output pulse voltages as shown by function 6.

FIG. 2 is a schematic diagram of an electric fence energiser in accordance with one embodiment of the present invention. An energy storage capacitor 11 is connected across the primary 12 of a transformer generally indicated by arrow 13. This secondary 14 of the transformer 13 is connected to an electric fence line 22. A control circuit 15 is connected to an SCR 16 which is operated by the control circuit 15 to discharge the storage capacitor 11 into the transformer 13. The control circuit 15 is preferably a microprocessor control circuit 15.

A controllable switch 17 in the form of triac is situated between a charging circuit 21 and the energy storage capacitor 11. The triac 17 is also connected to the microprocessor control circuit 15 which controls the opening and closing of the triac 17 and hence the charging of the energy storage capacitor 11.

A resistor 18 of a known value is the primary side of the energiser circuit. A sensing means in the form of lines 19 and 20 determines the voltage across the resistor 18. As the resistance of the resistor 18 is known, the current flowing in the circuitry can be calculated from the voltage. This current is indicative of the load on the secondary side of the energiser.

With the above information, the microprocessor control circuit 15 can then open or close the triac 17 in such a way as to ensure that the voltage on the energy storage capacitor 11 is as desired.

Aspects of the present invention have been discussed by way of example only, and it should be appreciated that modifications and additions may be made thereto without departing from the scope of the appended claims.

I claim:

1. An electric fence energiser comprising an energy storage capacitor, a controllable switch arranged to control a charge in said capacitor, a control circuit connected to said controllable switch, a sensing means that can relay information to said control circuit regarding a perceived electrical load on an output of the electric fence energiser, characterized in that said control circuit upon receipt of information from said sensing means operates said controllable switch so that the charge on said capacitor varies in such a way so as to allow a continuously varying range of output pulse voltages on the output once said capacitor is discharged.

2. An electric fence energiser as claimed in claim 1 wherein the perceived electrical load on the output of the electric fence energiser is determined by voltage feedback.

3. An electric fence energiser as claimed in claim 1 further comprising a transformer whose turns ratio is greater than 1:18 associated with said capacitor.

4. An electric fence energiser as claimed in claim 1 wherein said control circuit includes a microprocessor which receives feedback that provides an indication of the preceived electrical load on the output from said sensing means, said microprocessor being capable of deriving a value indicative of the voltage to be placed on said capacitor which provides the desired output voltage on the output once said capacitor is discharged.

5. An electric fence energiser as claimed in claim 4 wherein the value is calculated from a function programmed into said microprocessor.

6. An electric fence energiser as claimed in claim 4 wherein the value is derived from a table within memory means that said microprocessor accesses.

7. An electric fence energiser as claimed in claim 1 wherein said control circuit monitors the time that said controllable switch is opened or closed as a means of controlling the value to which said capacitor is charged.

8. An electric fence energiser as claimed in claim 1 wherein the voltage of said capacitor is adjusted by said control circuit and said controllable switch is operated until said capacitor has reached a preset value.

9. A method of operating an electric fence energiser, comprising the steps of:

monitoring a perceived electrical load on an electric fence energiser; and adjusting a voltage on an energy storage capacitor of the energiser, wherein the adjustment of the voltage on the capacitor takes place in accordance with a pre-determined response to the perceived electrical load on the energiser, the pre-determined response allowing for a continuous range of output pulse voltages on an electric fence line once the capacitor is discharged.

10. A method as claimed in claim 9 wherein the voltage on the capacitor follows a step function in accordance with preset voltage limits.

11. A method as claimed in claim 9 wherein the voltage on said capacitor is adjusted by a controllable switch attached to a sensing means to determine the preceived electrical load on the energiser.

12. A method as claimed in claim 9 wherein the effective load on the electric fence energiser is determined by monitoring the voltage on the output of the electric fence energiser.

13. A method as claimed in claim 9 wherein the voltage on the energy storage capacitor is controlled by a controllable switch attached to a sensing means to determine the perceived electrical load on the energiser.

14. A method as claimed in claim 9 wherein the perceived electrical load on the electric fence energiser is determined by monitoring the voltage on the output of the electric fence energiser.

15. An energiser for an electric fence and having an energiser output, said energiser comprising:

an energy storage capacitor;

switch means for controlling a charge in said capacitor;

a control circuit connected to said switch means; and sensing means for relaying information to said control circuit regarding a perceived electrical load on the energiser output;

wherein said control circuit upon receipt of the information from said sensing means operates said switch means so that the charge on said capacitor varies to allow a continuously varying range of output pulse voltages on the electric fence once said capacitor is discharged.

16. An energiser as claimed in claim 15 further comprising voltage feedback means for determining the preceived electrical load.

17. An energiser as claimed in claim 15 further comprising a transformer operatively connected to said capacitor and whose turns ratio is greater than 1:18.

18. An energiser as claimed in claim 15 wherein said control circuit includes a microprocessor which receives feedback that provides an indication of the perceived electrical load on the electric fence from said sensing means, said microprocessor being capable of deriving a value indicative of the voltage to be placed on said capacitor which provides the desired output voltage on the electric fence once said capacitor is discharged.

* * * * *